US007364440B2

(12) United States Patent
Gobron et al.

(10) Patent No.: US 7,364,440 B2
(45) Date of Patent: Apr. 29, 2008

(54) MULTI-LEAD KEYHOLE CONNECTOR

(75) Inventors: Stephane Gobron, Carlsbad, CA (US); Bill Gregory, Fort Lauderdale, FL (US); Vineet Bansal, Santa Clara, CA (US); Tom Nguyen, Coconut Creek, FL (US)

(73) Assignee: LifeSync Corporation, Fort Lauderdale, FL (US)

( * ) Notice: Subject to any disclaimer, the term of this patent is extended or adjusted under 35 U.S.C. 154(b) by 0 days.

(21) Appl. No.: 11/654,306

(22) Filed: Jan. 17, 2007
(Under 37 CFR 1.47)

(65) Prior Publication Data

US 2007/0167089 A1 Jul. 19, 2007

Related U.S. Application Data

(60) Provisional application No. 60/759,447, filed on Jan. 17, 2006.

(51) Int. Cl.
*H01R 12/00* (2006.01)

(52) U.S. Cl. ..... 439/77

(58) Field of Classification Search ..... 439/67, 439/493, 492, 495, 77

See application file for complete search history.

(56) References Cited

U.S. PATENT DOCUMENTS 3,606,881 A 9/1971 Woodson
3,828,766 A 8/1974 Krasnow
3,964,469 A 6/1976 Manley
3,995,644 A 12/1976 Parsons
4,026,278 A 5/1977 Ricketts et al.
4,029,381 A 6/1977 Tarrall et al.
4,030,796 A 6/1977 Patzer
4,042,305 A 8/1977 Vincent
4,044,497 A 8/1977 Bettens
4,063,791 A 12/1977 Cutchaw
4,111,518 A 9/1978 Zurcher
4,164,003 A 8/1979 Cutchaw
4,165,141 A 8/1979 Williams et al.
4,202,344 A 5/1980 Mills et al.
4,253,721 A 3/1981 Kaufman
4,353,372 A 10/1982 Ayer (Continued)

FOREIGN PATENT DOCUMENTS

WO PCT/US01/12549 10/2001

(Continued)

*Primary Examiner*—Michael C. Zarroli
*Assistant Examiner*—Phuongchi Nguyen
(74) *Attorney, Agent, or Firm*—Michael J. Keller; Lott & Friedland, P.A.

(57) ABSTRACT

An electrical connector for providing a watertight electrical connection between a flat, single or multi-traced, rigid and/or flexible printed circuit and a separate electronics unit. The electrical connector is comprised of a plug having one or more keyhole-shaped slots which serve to mechanically secure the connection between the one or more traces of the circuit and one or more fixed pins on the body of the separate electronics unit. The plug is placed over the one or more pins such that the pins are inserted up through the wider portion of the slots and in a push or pull action, the pins are slid into the narrower portion of the slot such that the pins are locked into place. The conductive traces are then secured into contact with the electrical contacts of the separate electronics device.

33 Claims, 8 Drawing Sheets

U.S. PATENT DOCUMENTS 4,488,770 A 12/1984 Lui et al.
4,490,005 A 12/1984 Hovey
4,541,679 A 9/1985 Fiedler et al.
4,625,397 A 12/1986 Voigt
4,671,591 A 6/1987 Archer
4,674,511 A 6/1987 Cartmell
4,685,467 A 8/1987 Cartmell et al.
4,757,817 A 7/1988 Healy
4,822,296 A 4/1989 Wilson
4,861,183 A 8/1989 Loos
4,974,594 A 12/1990 Berlin
4,998,875 A 3/1991 Starkey
5,054,170 A * 10/1991 Otrusina ..... 24/580.11
5,201,858 A * 4/1993 Otrusina ..... 24/573.11
5,214,569 A 5/1993 Hsiang
5,224,882 A 7/1993 Olms
5,244,400 A 9/1993 Hatagishi
5,261,402 A 11/1993 DiSabito
5,326,272 A * 7/1994 Harhen et al. ..... 439/86
5,431,573 A 7/1995 Endo et al.
5,754,412 A 5/1998 Clavin
5,788,633 A 8/1998 Mahoney
5,862,803 A 1/1999 Besson et al.
5,957,854 A 9/1999 Besson et al.
5,961,334 A * 10/1999 Inaba ..... 439/67
6,024,608 A 2/2000 Azuma et al.
6,045,375 A 4/2000 Aoki et al.
6,077,100 A 6/2000 Sakano
6,236,874 B1 5/2001 Devlin et al.
6,259,032 B1 7/2001 Fernandez
6,289,238 B1 9/2001 Besson et al.
6,319,039 B1 11/2001 Chambly
6,385,051 B1 5/2002 Perez et al.
6,410,851 B1 6/2002 Lamar et al.
6,434,410 B1 8/2002 Cordero et al.
6,441,747 B1 8/2002 Khair et al.
6,475,153 B1 11/2002 Khair et al.
6,496,705 B1 12/2002 Ng et al.
6,527,571 B2 3/2003 Muta et al.
6,533,729 B1 3/2003 Khair et al.
6,535,394 B1 3/2003 Hirzmann
6,577,893 B1 6/2003 Besson et al.
6,604,883 B2 8/2003 Broberg
6,611,705 B2 8/2003 Hopman et al.
6,695,629 B1 2/2004 Mayer
6,716,070 B2 4/2004 Christensson
D492,248 S 6/2004 Gregory et al.
D499,488 S 12/2004 Chastain et al.
6,851,970 B2 2/2005 Yamanashi
6,897,788 B2 5/2005 Khair et al.
6,987,965 B2 1/2006 Ng et al.
7,187,518 B2 * 3/2007 Hong et al. ..... 360/99.08
2003/0029907 A1 * 2/2003 Neidich et al. ..... 228/180.22
2003/0105403 A1 6/2003 Istvan et al.
2003/0199777 A1 10/2003 Hopman et al.
2004/0015058 A1 1/2004 Besson et al.
2004/0072475 A1 4/2004 Istvan et al.
2004/0073127 A1 4/2004 Istvan et al.
2004/0127802 A1 7/2004 Istvan et al.
2004/0186358 A1 9/2004 Chemow et al.
2005/0191874 A1 * 9/2005 Auchincloss et al. ..... 439/67
2005/0251002 A1 11/2005 Istvan et al.
2005/0251003 A1 11/2005 Istvan et al.
2005/0251004 A1 11/2005 Istvan et al.
2006/0058017 A1 3/2006 Ng et al.
2006/0258187 A1 * 11/2006 Behziz ..... 439/77

FOREIGN PATENT DOCUMENTS

WO PCT/US01/12562 10/2001
WO PCT/US01/15167 11/2001
WO PCT/US01/15201 11/2001
WO WO/02/05700 1/2002
WO WO/03/047427 6/2003
WO WO/03/061465 7/2003
WO WO/2004/002301 1/2004
WO WO/2004/004824 1/2004
WO WO/2004/028344 4/2004

* cited by examiner

MULTI-LEAD KEYHOLE CONNECTOR

This application claims priority to corresponding U.S. Provisional Application No. 60/759,447, filed on Jan. 17, 2006, which incorporates U.S. application Ser. No. 10/439,356, filed on May 16, 2003, U.S. application Ser. No. 11/077,934, filed on Mar. 11, 2005, U.S. application Ser. No. 11/105,230, filed on Apr. 12, 2005, U.S. application Ser. No. 11/105,231, filed on Apr. 12, 2005, U.S. application Ser. No. 11/105,232, filed on Apr. 12, 2005, U.S. application Ser. No. 09/998,733, filed on Nov. 30, 2001, and U.S. application Ser. No. 09/908,509, filed on Jul. 17, 2001, now U.S. Pat. No. 6,611,705, the disclosures and contents of which are expressly incorporated herein by reference.

FIELD OF INVENTION

The present invention relates to electrical connectors used to connect a single or multi-trace circuit to a separate electronic device.

BACKGROUND OF THE INVENTION

In a multi-traced circuit, it is often desired that each electrical signal corresponding to each individual trace be kept electronically isolated from the other traces so as to maintain the integrity of each signal. However, oftentimes it is not practical that each trace be individually connected to a separate electronic device. Therefore, the need arises for an electrical connector that forms a single connection between a plurality of electrical traces and a separate electronic device without distorting the quality of the individual electrical signals. The need for such connectors has long been recognized in the medical field for connecting a plurality of electrocardiogram (ECG) leads to a separate device for capturing, storing, and analyzing the electrical signals sensed by a plurality of electrodes placed on a patient's chest. Previously, it was common to connect each ECG lead wire individually to a separate electronic device which often led to entanglement and confusion between the wires.

A serial port connector has been used to electrically connect a plurality of leads to a separate electronics device with only a single connection. A plurality of leads are combined to form a single information cable which is thereafter connected to a male portion of a serial connector comprised of a plurality of pins, each corresponding to a separate lead. The male portion is inserted into the pin recesses of a female counterpart that is located within the separate electronic device. Such a connection device is practically limited to electrical systems which utilize a plurality of lead wires that are physically moveable to one another and are not confined to a single plane. In a printed circuit or a circuit confined to a flat substrate, the electrical traces cannot easily be gathered to form a single information cable for input into a serial port connector. Furthermore, a printed circuit is limited to lying flat in one plane and therefore, a cable attached will have significant cable strain. Such a limitation is significant as there are a variety of applications in which a flat circuit is used to provide an electronic pathway between electrical components. For example, revolutionary ECG apparatuses have been disclosed which provide more comfort and mobility to the patient and a more stable configuration upon the patient's chest in the form of a flat, flexible chest patch. Integrated within the chest patch are several electrical traces originating from the electrode sensing means such that a conventional serial port connector is not a practical connection to a separate electronics device.

Typically with such flat circuits, the printed traces terminate along a common, flat trunk or terminal at one end of the circuit such that the traces are aligned adjacent to one another while still maintaining electrical isolation. The flat, printed circuit design is carried through to a connector plug that is attached to the end of the trunk. At the very end of the common trunk, the printed circuit traces ordinarily extend to corresponding contact strips or flat pins of a male connector portion. Where the contact strips lie, the insulating top surfaces of the flat substrate are ordinarily removed leaving the contact strips exposed along a support layer. These contact strips may also be printed conductors but may be formed of a different metal that is better suited for their insertion into a female connector socket located in a separate electrical device. Various mechanisms by which the male connector is inserted and held within the female socket have been disclosed. For example, the female socket may contain a plurality of spring contacts which mate with the contact strips upon insertion of the male connector. Clamps containing a series of teeth are biased into contact with the springs such that the springs are held against the inserted connector. Furthermore, the female socket may contain finger hooks which hook onto apertures that may be formed on the male connector thereby securing the male connector within the female socket. However, due to the fact that these insertion-type connectors require multi-part internal mechanisms for securing the connector at the female socket, they are complex to manufacture, hard to clean, and it is difficult to maintain a waterproof connection.

It is an object of this invention to provide a simpler mechanism for connection between a flexible, flat circuit that contains conductive electrical traces to a separate electronics device. The conductive traces terminate on the bottom of a female connector plug that contains one or more keyhole-shaped slots where each trace corresponds to one slot. Insert-molded pins corresponding to each of the keyhole-shaped slots are located on the surface of the body of a separate electronics device. Proximate to the pins are electrical contacts in the body's surface. The plug is placed over the pins such that the pins are inserted up through the wider portion of the slots and in a push or pull action, the pins are slid into the narrower portion of the slot such that the pins are locked into place. The conductive traces are then secured into contact with the electrical contacts of the separate electronics device. Therefore, all of the connecting parts are made by simple construction and are found on easily accessible, exterior surfaces of the plug and body rather than on an interior surface that is difficult to reach and hard to clean.

It is an object of this invention to provide a completely waterproof mechanism for connection between a flexible, flat circuit that contains conductive electrical traces to a separate electronics device. In the assembly described above, a single rubber gasket is placed on the surface of the body where the body contacts the plug thereby creating a completely waterproof fit between the plug and the body when in connection with one another. Due to the fact that the plug is connected to the body simply by sliding the plug in an overlapping configuration about the body surface such that the electrical contacting parts are sandwiched between the two surfaces, waterproofing is made easy by simply applying a gasket between the two surfaces.

DETAILED DESCRIPTION

The present invention is a keyhole-shaped electrical connector that is used to connect a single or multi-trace, rigid or flexible circuit to a body of a separate electronics device comprised of one or more fixed pins which serve to mechanically secure the connection between the trace(s) and electrical contacts on the body. In addition to the mechanical use, preferably the pins also maintain electrical continuity between the circuit and the body. The system is designed to be waterproof in such a way that the electrical connection is maintained even while immersed in fluid after the system has been assembled and can be easily cleaned. The arrangement is particularly suitable for securing multiple electrical traces within a flexible membrane circuit of an ECG chest assembly to the body of an electronics unit located on a patient for wireless transmission of ECG data. Electrically conductive tracings may be applied as silver epoxy ink or other conductive means known in the art to a non conductive, flexible substrate such as Mylar.

Figure 1:
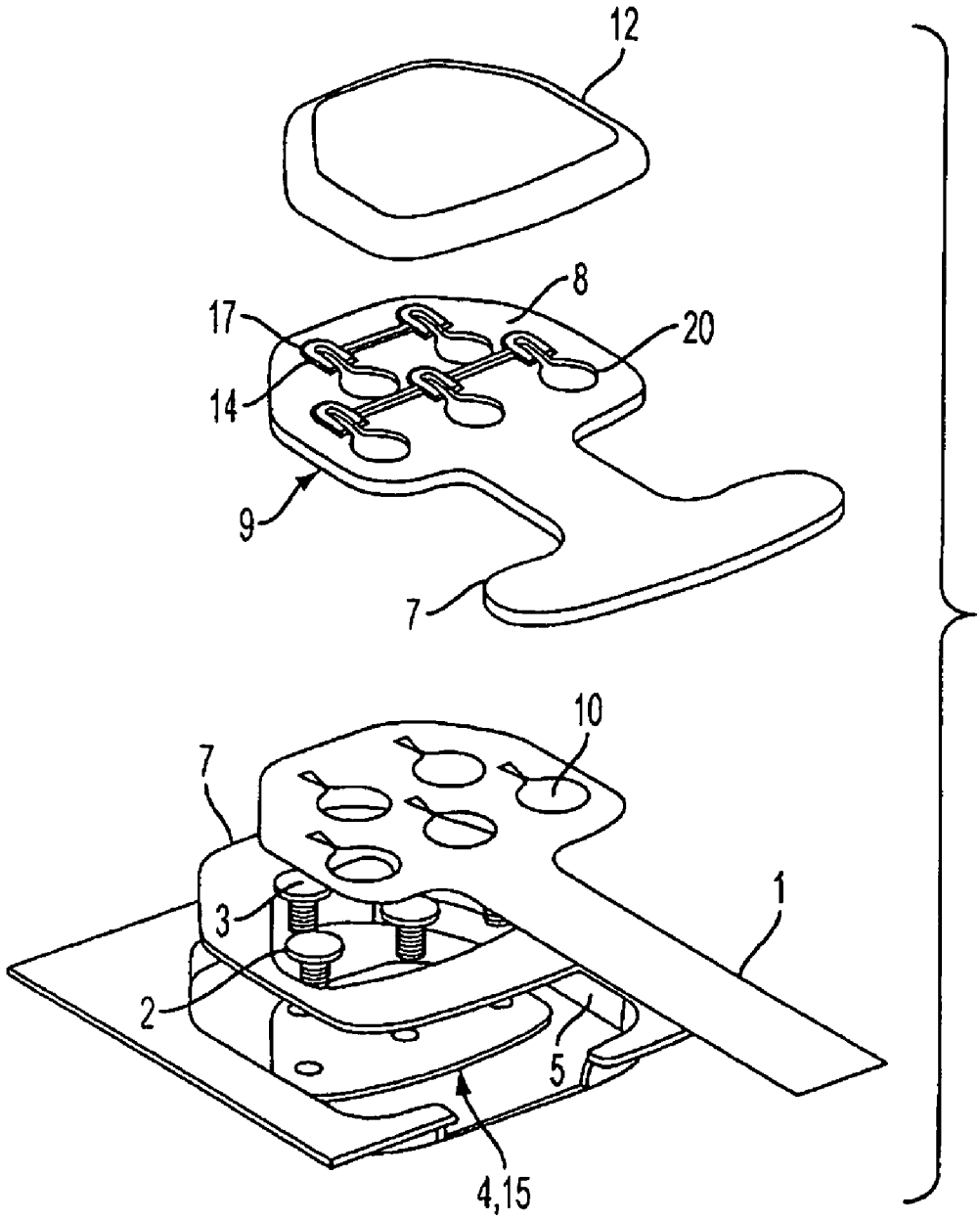
FIG. 1 is an exploded view of the connector assembly.
Figure 2:
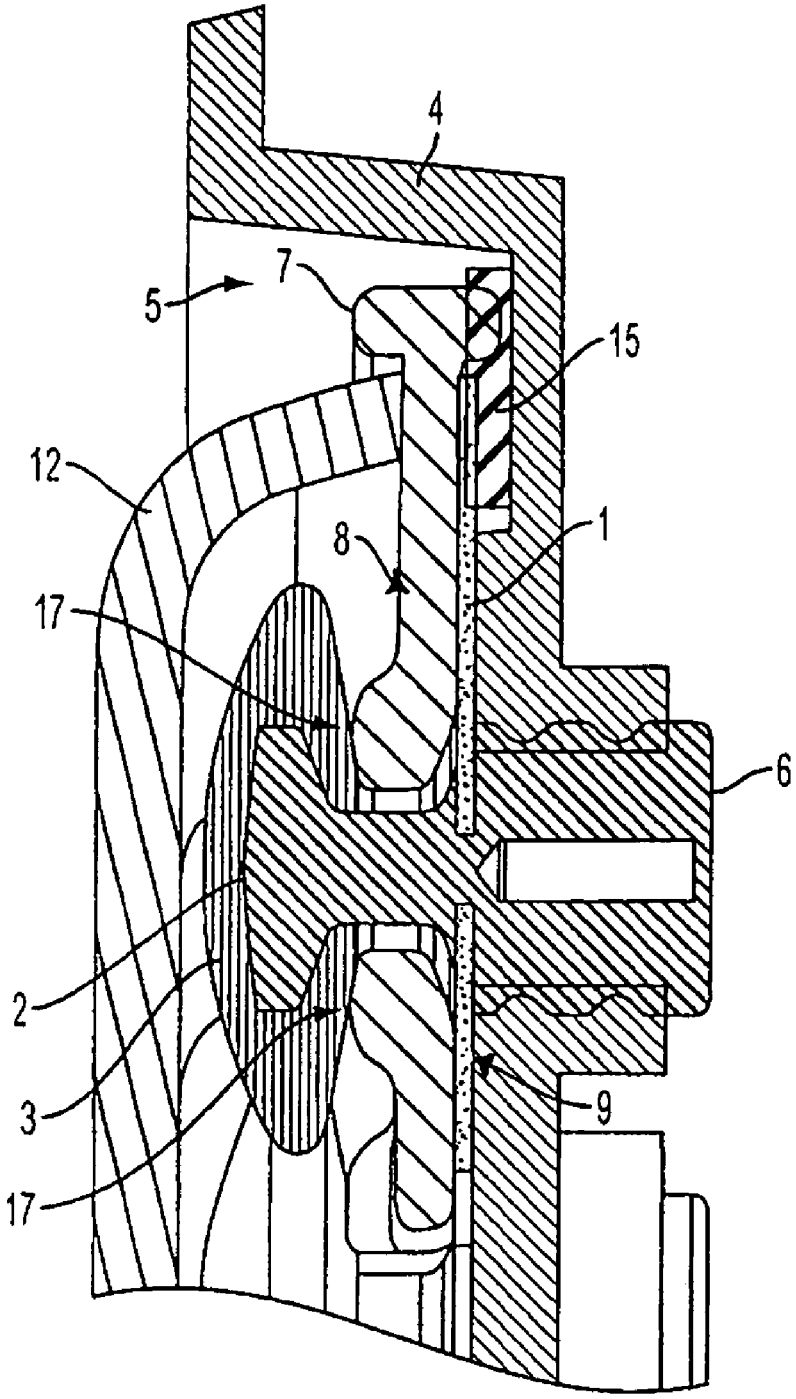
FIG. 2 is a cross section of the connector in an engaged configuration showing the retaining feature.

Referring to FIGS. 1 and 2, body 4 of the male portion of the connector may contain one or more pins 2 having a conductive element or being made from a conductive material including a conductor or a metallic conductive material in a recessed portion 5 of its surface. The pins have a wide mushroom-head shaped cap and a base of narrower diameter. The pin cap may be further covered by an insulation cap 3 that is preferably composed of a non conductive material such as a plastic or an elastomer. In the surface of the body, proximate to the pins, are electrical contacts 6. The male connector is preferably incorporated into the body of a separate patient electronics unit but may be incorporated onto a conductive cable extending from such patient electronics unit.

Figure 3A:
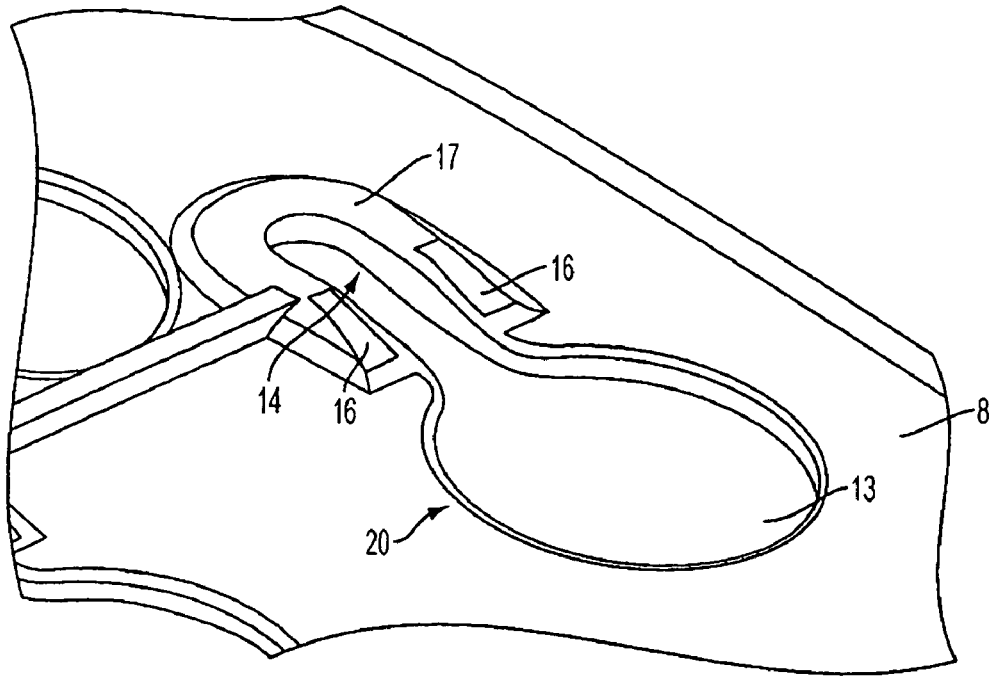
FIG. 3A is a top view of the female plug of the connector showing the keyhole-shaped slots and the ramp feature for locking the connector.
Figure 3B:
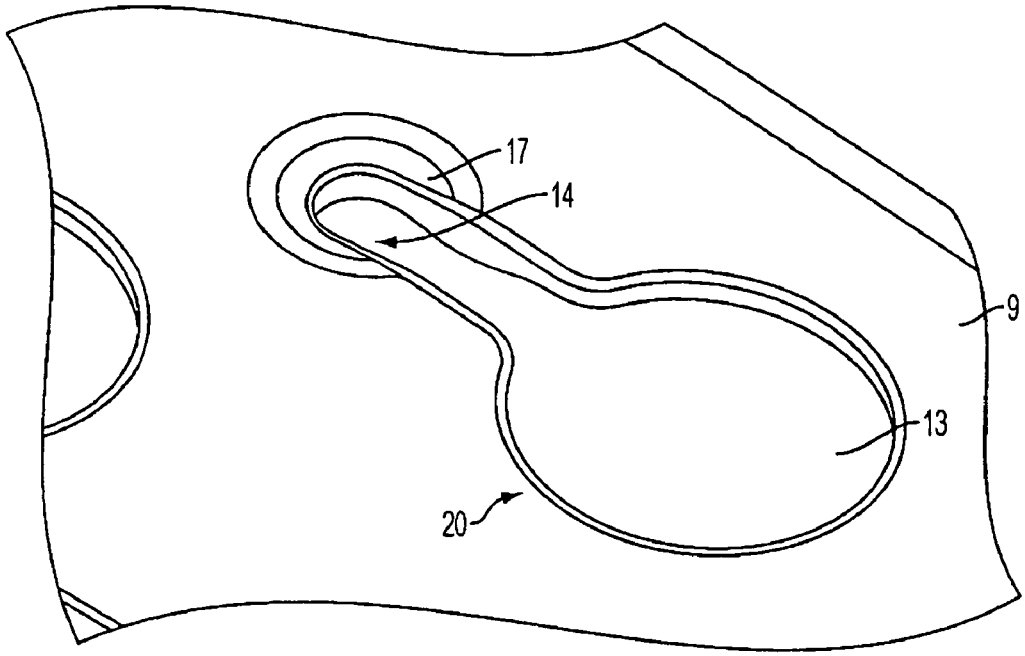
FIG. 3B is a bottom view of the female plug of the connector showing the cone feature for locking the connector.
Figure 7A:
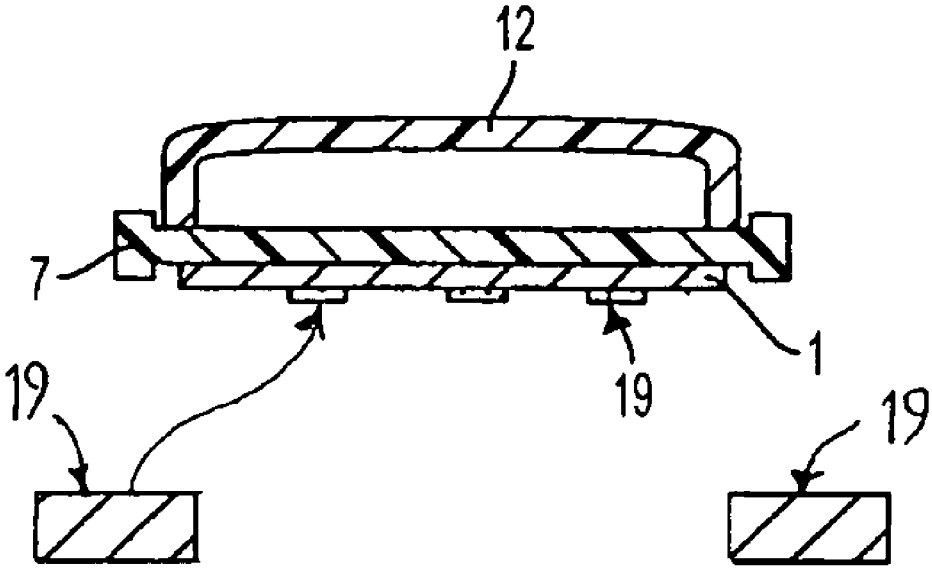
FIGS. 7A and 7B show a cross section of the assembled connector including single-sided and double-sided adhesive layers respectively.
Figure 7B:
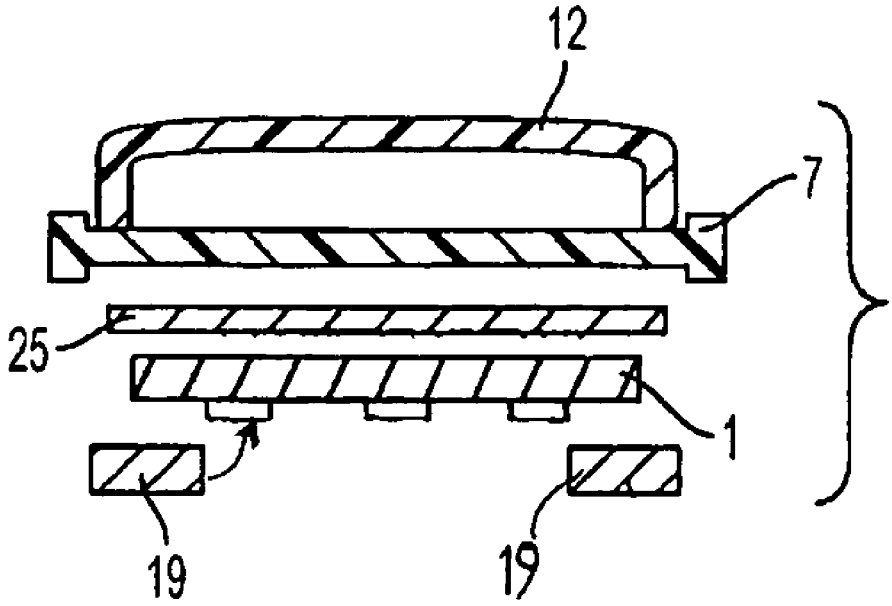

The connector is comprised of a female plug portion 7 with top surface 8 and bottom surface 9. Preferably, the plug is comprised of a nonconducting plastic. The top surface 8 may be in the form of a dome-shaped cover 12 that is attached to the bottom surface [as shown in FIG. 1] such that the unit is reasonably waterproof when assembled. As shown as exposed in FIGS. 1, 4A and 4B, bottom surface 9 of the female plug portion contains one or more keyhole-shaped slots 20 which correspond to pins 2 located on the body of the separate electronics device. As shown in FIGS. 3A and 3B, the keyhole-shaped slot is comprised of a portion of wide diameter 13 that opens into a portion of narrower diameter 14. Portion 13 is depicted in the shape of a circle for illustrative purposes only and in no way limits the shape of portion 13 to a circle. Any shape can be used as long as one portion is large enough to receive the mating pin and another portion is small enough to retain the pin when engaged in the slot. Referring to FIGS. 1 and 5, flexible circuit 1 terminates on the bottom surface of the plug such that each electronic trace 11 within flexible circuit 1 corresponds to one keyhole-shaped slot 10. As shown in FIG. 7B, a double-sided foam adhesive 25 may be applied between the bottom surface 9 of plug 7 and flexible circuit 1 in order to retain the circuit on the bottom surface of the plug. Additionally, a single-sided foam adhesive layer 19 may be applied to the bottom surface of the flexible circuit as shown in FIG. 7A.

Figure 4A:
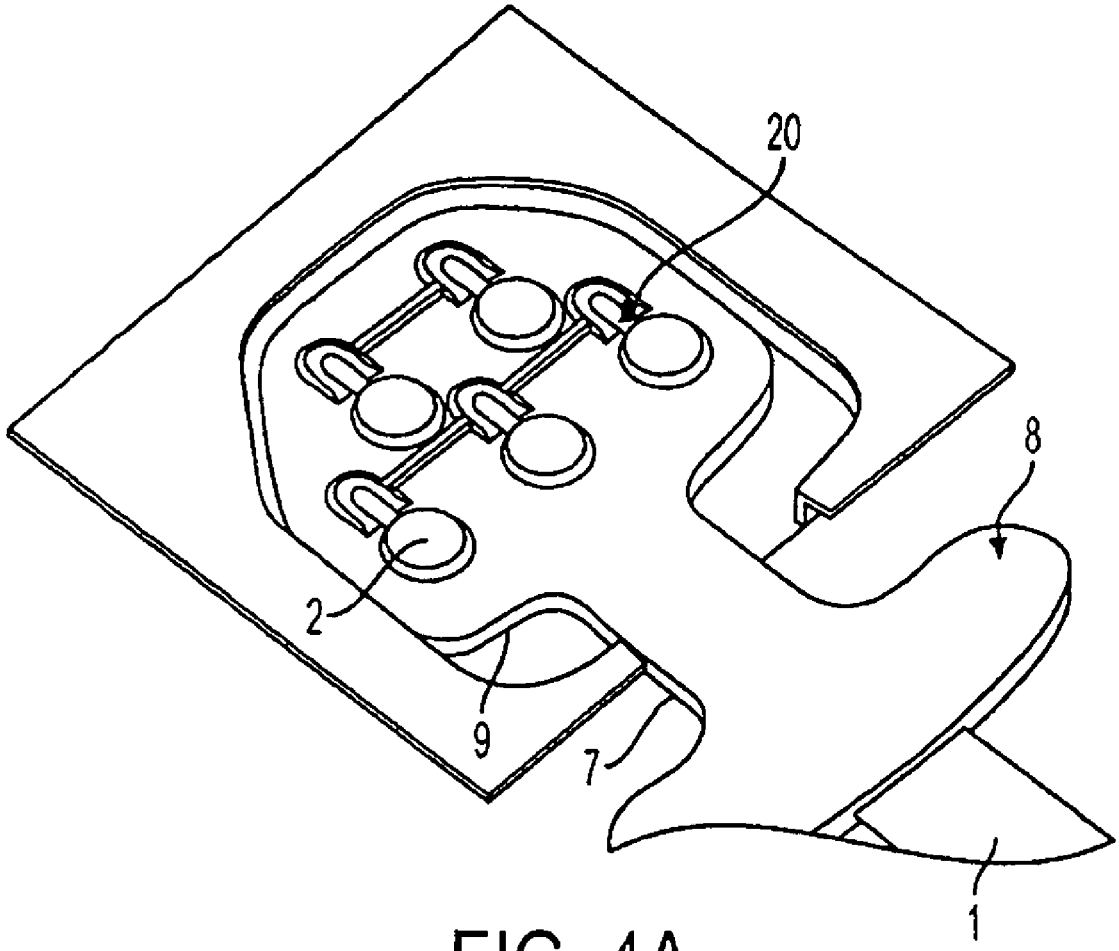
FIGS. 4A and 4B illustrate a connector containing a plurality of connections in their unlocked and locked states respectively.
Figure 4B:
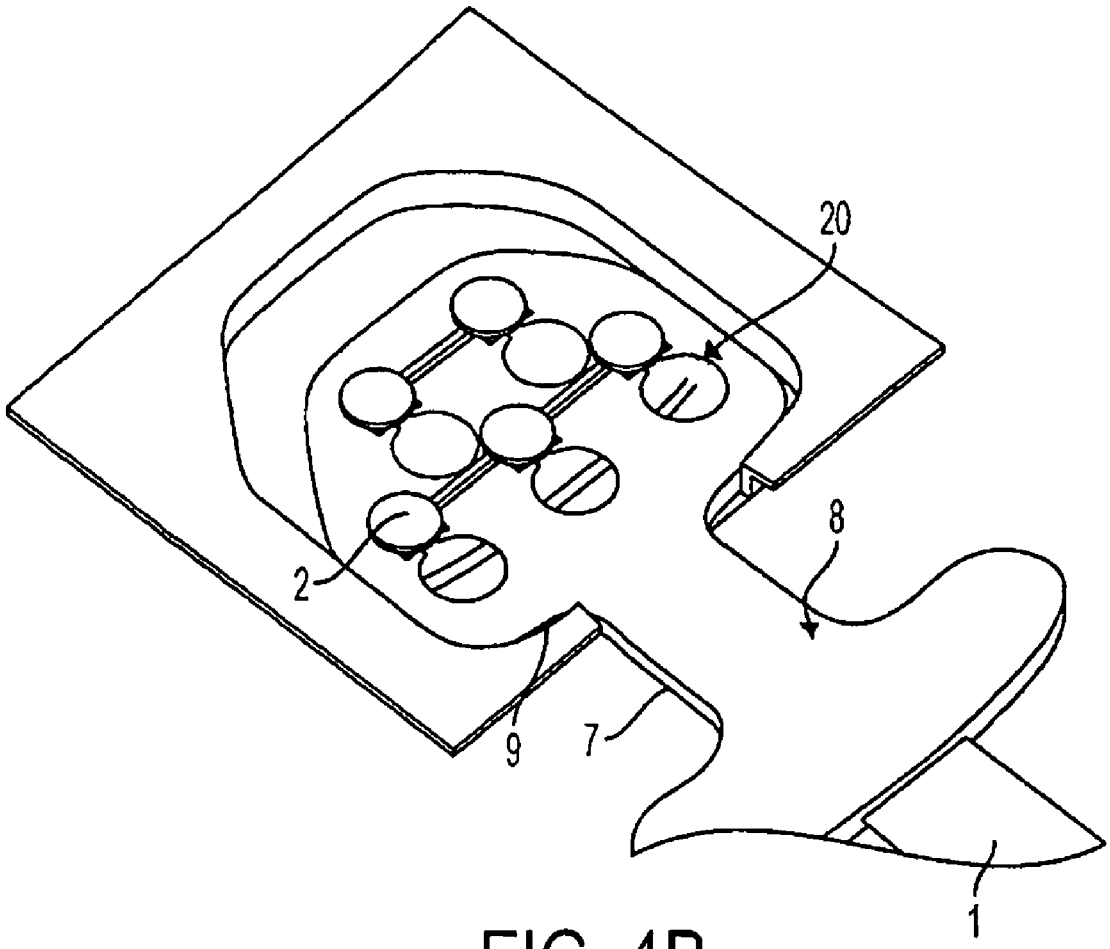
Figure 5:
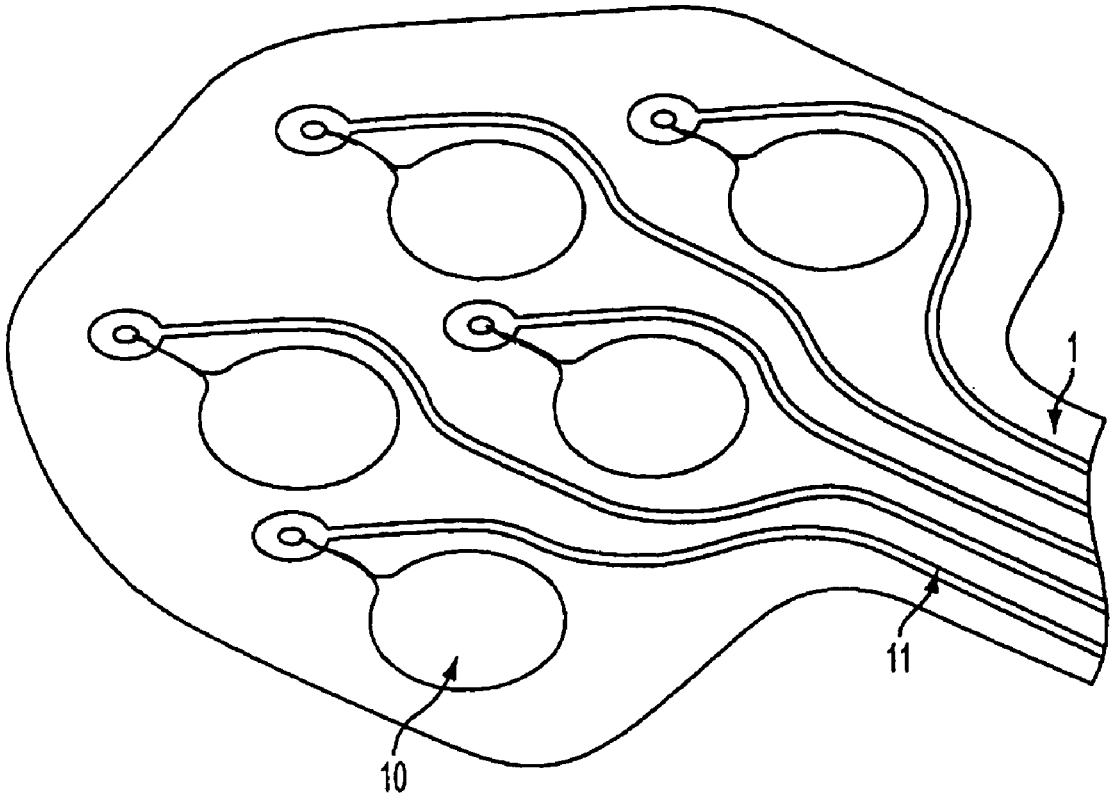
FIG. 5 shows the flat, printed circuit with electrical traces and the corresponding keyhole-shaped cutouts.

In order to engage the electrical traces 11 on female plug 7 in electrical contact with contacts 6 of body 4, portion 13 of slots 10 are first placed over pins 2 such that the pins come through portion 13 as shown in FIG. 4A. Thereafter, in either a simple push or pull sliding action, the pins are forced through the narrower portion 14 such that the pins are restrictively secured in place at the end of slots 20 in a single orientation as shown in FIG. 4B. Referring to FIGS. 1, 2 and 3A, a cone structure 17 may be applied to the narrow end 14 of slot 20 in order to provide better gripping force and a larger surface area for electrical connection between plug 7 and pins 2. As shown in FIG. 3B, electrical traces 11 of flexible circuit 1 are deflected along the undersurface of cone 17 thereby creating a larger surface area for electrical connection between traces 11 and pins 2. As also shown in FIGS. 1 and 3A, ramp structure 16 is placed along the narrower portion 14 such that pin 2 glides easily into electrical contact with cone structure 17. The cone and ramp structures may be composed of any material with suitable mechanical and electrical properties with cardboard or plastic being most preferred.

Alternatively, pins 2 may also serve as a point of electrical contact between electrical traces 11 on plug 7 and body 4.

As shown in FIGS. 1 and 2, a rubber or other type of gasket material 15 may be applied to the recessed surface 5 on body 4 such that the gasket surrounds pins 2 of the male portion of the connector in order to ensure a watertight seal between plug 7 and body 4 when brought into contact.

Figure 6A:
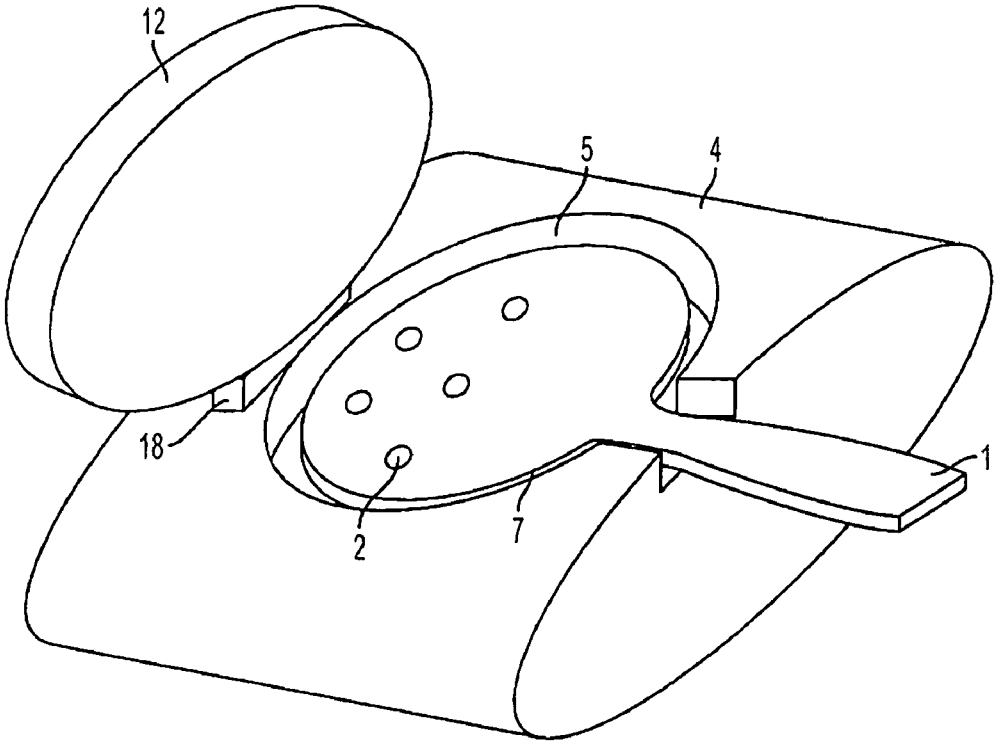
FIG. 6A shows an alternative embodiment in which the flat, flexible circuit is held in place with an encapsulating dome.
Figure 6B:
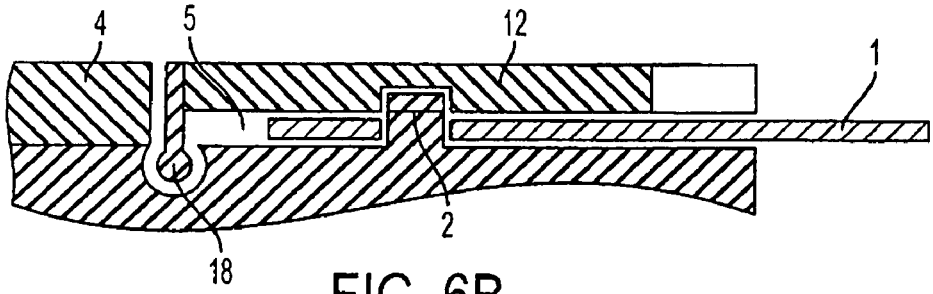
FIG. 6B is a cross section of a circuit held in place with the encapsulating dome of FIG. 6A.

In an alternative embodiment as shown in FIGS. 6A and 6B, dome cover 12 does not form the top surface of plug 7 but rather, is composed of rubber and is attached to the body 4 using a living hinge 18. After the plug is secured to the pins, the dome is closed at the hinge and press fit into the recessed portion 5 of the body thereby covering or encapsulating the plug so as to provide a watertight seal.

The invention claimed is:

1. A connector for making an electrical connection between a flexible circuit and a separate electronic device comprised of:

a female plug having a top and bottom surface wherein the plug has at least one keyhole-shaped slot;

a flexible circuit, having at least one conductor, that is attached to the female plug wherein the flexible circuit contains a keyhole corresponding to a keyhole slot in the female plug, wherein the conductor is exposed around at least a portion of the keyhole slot, each slot having a portion of wider diameter that opens into a slot of narrower diameter for entirely enclosing at least one corresponding pin on a male connector body of a separate electronics device; and the male connector body having at least one pin where said at least one pin is comprised of a head, body and base attached to the surface of the male connector body, the head being sized to fit through the large diameter portion of the keyhole-shaped slot and a narrow conductive body sized to be slidingly received within the narrow diameter of the keyhole-shaped slot such that when the keyhole-shaped slot is slid over the pin from the wider to narrower portion, the wide head locks the conductive body inside said plug thereby making an electrical contact between said male connector body and said female plug.

2. The connector according to claim 1 wherein said plug is comprised of a non conductive material.

3. The connector according to claim 1 wherein said at least one pin is comprised of plastic.

4. The connector according to claim 1 and further comprising an insulating cap which surrounds the head of said at least one pin.

5. The connector according to claim 1 and further comprising a rubber gasket on the surface of said body where said at least one pin is attached such that a watertight seal is formed between said body and said female plug when connected.

6. The connector according to claim 1 and further comprising an adhesive that is applied to the bottom surface of said female plug such that the adhesive is between the plug and said flexible circuit.

7. The connector according to claim 1 and further comprising a single-sided foam adhesive that is applied to the bottom of said flexible circuit.

8. The connector according to claim 1 wherein the top surface of said female plug is comprised of a cover.

9. The connector according to claim 8 wherein the cover is attached to the bottom surface of said female plug such that the cover is water resistant.

10. The connector according to claim 1 and further comprising a raised concave cone-shaped structure surrounding the at least one keyhole-shaped slot of said female plug, said concave cone-shaped structure corresponding to a convex base structure on said at least one pin whereby the concave and convex structures when engaged improve the strength of the physical connection of the male connector body and the female plug.

11. The connector according to claim 10 and further comprising a raised ramp structure surrounding the narrower portion of said at least one keyhole-shaped slot of said female plug such that the said at least one pin must traverse the ramp before the said cone-shaped structure while the slot and pin are engaged.

12. The connector according to claim 10 wherein the said flexible circuit trace is applied to the underside surface of said cone-shaped structure such that the circuit trace is deflected along the surface of said at least one pin while the slot and pin are engaged.

13. A water resistant connector for an electrical connection between a flexible, printed circuit and a separate electronics device comprised of:

a nonconducting plug having a dome-shaped top surface and a flat bottom surface wherein the nonconducting plug has at least one keyhole-shaped slot;

a single or multi-traced flexible circuit attached to the plug wherein the flexible circuit has at least one electrical trace corresponding to the at least one keyhole-shaped slot in the nonconducting plug, each slot having a portion of wider diameter that opens into a slot of narrower diameter for entirely enclosing at least one corresponding pin on a recessed portion of a male connector body of a separate electronics device; and at least one pin attached to the surface of said body having a wide head sized to fit through the wider diameter portion of the keyhole-shaped slot and a narrow body sized to be slidingly received within the narrow diameter of the keyhole-shaped slot such that when the keyhole-shaped slot is slid over the pin from the wider to narrower portion, the wide head locks the pin inside said plug in a single orientation and makes an electrical contact between said circuit and electrical contacts located in the body of a separate electronics device; and a rubber gasket applied to the surface of said body where said at least one pin is attached such that a watertight seal is formed between said body and said plug when connected.

14. The connector according to claim 13 wherein said plug is composed of plastic.

15. The connector according to claim 13 wherein said at least one pin is composed of plastic and is molded onto the surface of said body.

16. The connector according to claim 13 and further comprising an insulating cap which surrounds the head of said at least one pin.

17. The connector according to claim 13 wherein the dome-shaped cover is attached to the bottom surface of said plug by ultrasonic welding such that the attachment is watertight.

18. The connector according to claim 13 and further comprising a double-sided foam adhesive that is applied to the bottom surface of said plug such that the foam adhesive is between the plug and said flexible circuit.

19. The connector according to claim 13 and further comprising a single-sided foam adhesive that is applied to the bottom of said flexible circuit.

20. The connector according to claim 13 and further comprising a raised cone-shaped structure surrounding the narrower portion of said at least one keyhole-shaped slot of said plug so as to better grip the said at least one pin while slot and pin are engaged.

21. The connector according to claim 20 and further comprising a raised ramp structure surrounding the narrower portion of said at least one keyhole-shaped slot of said plug such that the said at least one pin must traverse the ramp before the said cone-shaped structure while the slot and pin are engaged.

22. The connector according to claim 20 wherein the said flexible circuit trace is applied to the underside surface of said cone-shaped structure such that the circuit trace is deflected along the surface of said at least one pin while the slot and pin are engaged.

23. A connector for electrical connection between a single or multi-traced circuit and a separate electronic device comprised of:

a nonconducting plug having a flat surface having at least one keyhole-shaped slot;

a single or multi-traced flexible circuit attached to the plug wherein the flexible circuit has at least one electrical trace corresponding to the at least one keyhole-shaped slot in the nonconducting plug, each slot having a portion of wider diameter that opens into a slot of narrower diameter for entirely enclosing at least one corresponding pin on a male connector body of a separate electronics device;

at least one pin attached to the surface of the body having a wide head sized to fit through the wider diameter portion of the keyhole-shaped slot and a narrow body sized to be slidingly received within the narrow diameter of the keyhole slot such that when the keyhole slot is slid over the pin from the wider to narrower portion, the wide head locks the pin inside said plug in a single orientation and makes an electrical contact between said circuit and electrical contacts located in the body of a separate electronics device.

24. The connector according to claim 23 wherein said plug is composed of plastic.

25. The connector according to claim 23 wherein said at least one pin is composed of plastic and is insert-molded onto the surface of said body.

26. The connector according to claim 23 and further comprising an insulating cap which surrounds the head of said at least one pin.

27. The connector according to claim 23 and further comprising a dome-shaped cover attached to the surface of said body by a living hinge such that when said plug is connected to pins on said body, the cover may be closed over the connection in an encapsulating, watertight fashion.

28. The connector according to claim 23 and further comprising a rubber gasket on the surface of said body where said at least one pin is attached such that a watertight seal is formed between said body and said plug when connected.

29. The connector according to claim 23 and further comprising a double-sided foam adhesive that is applied to the bottom surface of said plug such that the foam adhesive is between the plug and said flexible circuit.

30. The connector according to claim 23 and further comprising a single-sided foam adhesive that is applied to the bottom of said flexible circuit.

31. The connector according to claim 23 and further comprising a raised cone-shaped structure surrounding the narrower portion of said at least one keyhole-shaped slot of said plug so as to better grip the said at least one pin while slot and pin are engaged.

32. The connector according to claim 31 and further comprising a raised ramp structure surrounding the narrower portion of said at least one keyhole-shaped slot of said plug such that the said at least one pin must traverse the ramp before the said cone-shaped structure while the slot and pin are engaged.

33. The connector according to claim 31 wherein the said flexible circuit trace is applied to the underside surface of said cone-shaped structure such that the circuit trace is deflected along the surface of said at least one pin while the slot and pin are engaged.

* * * * *